US005558035A

United States Patent [19]

Klein

[11] Patent Number: 5,558,035

[45] Date of Patent: Sep. 24, 1996

[54] SPINNAKER POLE AND DIP POLE JIBING SYSTEM USING SAME

[75] Inventor: Jeffrey F. Klein, Baltimore, Md.

[73] Assignee: Chesapeake Advanced Sail Hardware, Inc., Baltimore, Md.

[21] Appl. No.: 500,131

[22] Filed: Jul. 10, 1995

[51] Int. Cl.[6] ..... B63H 9/10

[52] U.S. Cl. ..... 114/89

[58] Field of Search ..... 114/89, 102, 103, 114/97, 98

[56] References Cited

U.S. PATENT DOCUMENTS

| | | | |
|---|---|---|---|
| 3,185,121 | 5/1965 | Nilsen | 114/103 |
| 3,207,114 | 9/1965 | Moseley | 114/102 |
| 3,228,372 | 1/1966 | Ridder et al. | 114/102 |
| 5,109,786 | 5/1992 | Hall | 114/89 |
| 5,347,945 | 9/1994 | McAlpine | 114/89 |

*Primary Examiner*—Sherman Basinger
*Attorney, Agent, or Firm*—Sughrue, Mion, Zinn, Macpeak & Seas

[57] ABSTRACT

A dip jibe spinnaker pole constituted by an elongated spinnaker pole tubular body having an inboard end fitting at one end for detachably pivotably mounting the spinnaker pole to the mast and provided with an outboard end fitting about which four sheaves are pivotably mounted via bases to the periphery of the outboard end fitting stinger rod for articulation through an arc of at least 180° at four circumferentially spaced positions. Three snatch guys led through the pole from the inboard end and through the outboard end fitting and through respective sheaves terminate in snap shackles for loosely coupling of the same to sheet/guy control lines connected at one end respectively to port and starboard clews at the foot of the spinnaker sail. A baby lift line is led through the pole from the inboard end and through the outboard end fitting and through the fourth sheave at the top of the pole outboard end fitting, with the snatch guys and the baby lift being controlled at the inboard end of the spinnaker pole to eliminate the need for a bow man and to permit one man on one side of the spinnaker pole to control all of the lines necessary to effect a dip pole jibe of the spinnaker.

13 Claims, 3 Drawing Sheets

SPINNAKER POLE AND DIP POLE JIBING SYSTEM USING SAME

FIELD OF THE INVENTION

This invention relates to spinnaker poles for adjustably fixing the weather side position of a spinnaker sail for a sailboat, and more particularly to a spinnaker pole construction which facilitates jibing of the spinnaker without the necessity for having one or more crew members at the bow during the jibing operation.

BACKGROUND OF THE INVENTION

As may be appreciated by anyone watching the 1995 America's Cup races off San Diego, even in the sophisticated America's Cup boats there is required that a bow man station himself at the bow of the sailboat and facilitate the jibing of the spinnaker by making changes to the guy sheets to permit the passage of the spinnaker pole, after its outboard end is lowered to permit it to swing through or dip to the rear of the forestay and move from the starboard side of the yacht to the port side or vice versa, where a connection is made to the opposite side guy. In larger sailboats each clew to opposite sides of the spinnaker along the foot has attached both a sheet and a guy. The active guy is released during a spinnaker jibe to one side of the forestay, and upon complete dipping of the pole about the back of the forestay, the new guy is attached to the spinnaker opposite side. Such difficulty is increased as a result of the bow of the yacht rising and dipping into the sea as a result of the wave conditions.

Dip pole jibing, where the outboard or distal end of the spinnaker pole is detached from the previously active guy as the boat shifts from a reaching condition to a direct downward state, has been improved over the years in an effort to reduce or eliminate the number of crew required at the bow and to perform all necessary control functions at or near the mast where the proximate or inboard end of the pole is swingably coupled to the mast.

U.S. Pat. No. 3,185,121 to Nilsen is an improvement over the basic dip pole spinnaker jibe system of the twelve meter yacht Vim which utilized a single retractable spring biased pin to selectively lock in a given guy to the end of the spinnaker pole. In the VIM jibing maneuver, the pin had to be pulled rearwardly against the spring bias to release the active guy, the pole dipped through and behind the forestay, and the new guy locked in. Nilsen, in the utilization of two side-by-side spring biased pins, permits the guys, after the ends are snapped into the respective clews of the spinnaker, to be locked into respective sides of the spinnaker pole at its outboard end. In such system, upon release of the active guy, the pole is permitted to swing across the bow under the forestay by releasing the spinnaker pole topping lift and pulling in on the after guy to the opposite side. The need for a bowman is then eliminated and all action takes place at or aft of the mast.

U.S. Pat. No. 3,207,114 to Moseley utilizes a similar arrangement for jibing the spinnaker while incorporating a locking mechanism within the outboard end of a hollow metal spinnaker pole to lock in special locking cones bearing rings coupled to the snap shackle bearing outhaul lines leading to the respective spinnaker clews. The pair of outhaul lines pass through the hollow spinnaker pole. When the active outhaul line is tensioned, with the pole to a respective side of the forestay at a desired position, the co-attached sheet to the snap shackle at the clew proximate to the spinnaker pole outboard end is then slacked. As a result, the tack of the spinnaker is automatically engaged by and securely locked to the outboard end of the spinnaker pole.

U.S. Pat. No. 3,228,372 to Ridder et al. utilizes, in a dip pole jibing system, a hollow spinnaker pole, port and starboard side jibing lines passing through the hollow pole and terminating in a ring sized larger than the ring-like fairlead at the outboard end of the spinnaker pole and being coupled to a respective guy. The inboard ends of the port and starboard side jibing lines pass through fairlead slots to the exterior of the pole end adjacent to the spinnaker pole pivot connection to the mast. The jibing lines are led through head knocker blocks which include jam cleats for locking the line at a desired position.

U.S. Pat. No. 5,109,786 to Hall is directed to an outboard end fitting for a spinnaker pole which is freely rotatable about the longitudinal axis of the pole and which provides on opposite sides of the axis a pair of fairleads for freely passing respective guys to the clews of a spinnaker. The free rotation of the fitting allows a tensioned guy to align to the respective fairlead, thereby avoiding twisting of that guy. Detaching and re-attaching of guys to the pole during jibing is avoided to facilitate dip pole spinnaker jibing without the necessity of a bow man.

U.S. Pat. No. 5,347,945 to McAlpine is directed to a spinnaker pole control system and a spinnaker pole outboard end fitting using double pairs of fore and aft rollers or pulleys vertically stacked and pivoting about a vertical axis at right angles to the longitudinal axis of the spinnaker pole, being closely spaced and between the peripheries of respective top and bottom rollers, port and starboard spinnaker pole brace lines are fed. The fitting is fixed to the pole and the orientation of the line feed passages as defined by the pulleys are rollers is highly restricted.

While the spinnaker poles and dip pole jibing systems as set forth in the patents discussed above eliminate the necessity for a bow man at the forestay during jibing, the spinnaker pole structure fails to segregate a plurality of lines including control lines passing through the spinnaker pole and to minimize friction on these lines under the heavy loads imparted by high velocity wind conditions acting on the spinnaker, resulting in line failure due to misalignment of the lines and the fairleads or pulley grooves, where sheaves are employed within the spinnaker pole apparatus itself.

It is therefore a primary object of the invention to provide an improved spinnaker pole for facilitating dip pole jibing without the need of a bow man, which preferably utilizes a single control line to each clew of the spinnaker which alternately function as a sheet for controlling the leeward edge of the spinnaker or a guy for fixing the weather edge of the spinnaker at the clew to the spinnaker pole, which preferably utilizes four lines led through the spinnaker pole and fed through articulating sheaves at circumferentially spaced positions about the pole at its outboard end to permit self-alignment of the sheave pulley groove to the axis of the guy line extending from the clew to the articulated sheave, while allowing the articulating sheaves to swivel or swing through 180° or greater, thereby minimizing the friction between the control lines and the respective sheaves of the jibing system.

It is a further object of the present invention to provide a double swing axis sheave for a third, changing snatch guy which is mounted to the bottom of the spinnaker pole at its outboard end for swinging through dual pivot axes parallel to the axis of the pole such that the sheave may swing through in excess of 360° for self-positioning parallel to an active sheave, either to the port side or starboard side of the yacht, to assist in controlling a new spinnaker to replace the existing spinnaker during changing of spinnakers.

It is a further object of the present invention to provide an improved spinnaker pole and dip pole jibing system which incorporates, as a fourth line within the hollow spinnaker pole, a baby topping lift line which is led through a fourth articulated sheave at the top of the outboard end of the spinnaker pole and connects to a conventional topping lift via single or double purchase arrangement, thereby permitting during jibing the dipping of the outboard end of the spinnaker pole by taking up the inboard end of the baby topping lift line through a fairlead slot at the inboard end and adjacent to its mast connection of the spinnaker pole.

It is a further object of the present invention to employ snatch guys as lines terminating in snap shackles carried by the hollow spinnaker pole, with the snap shackles loosely locked around respective guy and sheet primary control lines, solely connected to the respective clews of the spinnaker.

DESCRIPTION OF THE PREFERRED EMBODIMENT

Figure 1:
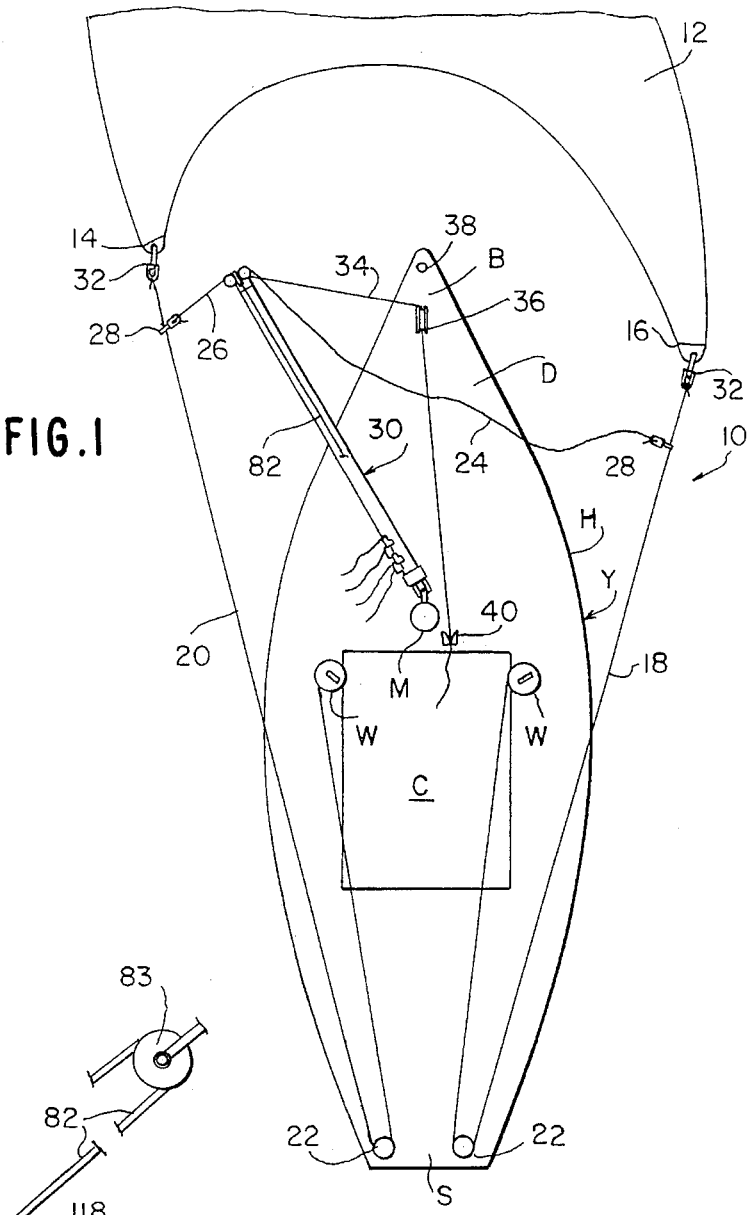
FIG. 1 is a schematic top plan view of the improved dip pole jibing system of the present invention.

Referring to FIG. 1, the invention is directed in part to an improved self-jibing spinnaker system indicated at 10 for a yacht indicated generally at Y and comprised of a hull H supporting a main mast M forward of a cockpit C extending generally from the mast to the stern S away from a bow B. Purposely, the only sail illustrated is a spinnaker 12 which is shown under port jibe conditions with a leading edge clew 14 forward of a trailing edge clew 16 which is controlled by a starboard sheet/guy 18 and with the port sheet/guy 20 slacked. The yacht includes a pair of winches W to opposite sides of the cockpit aft of the main mast M. Additionally, a pair of sheaves or pulleys 22 adjacent to the stern and on opposite sides of the hull H provide leads for the port and starboard sheet/guy spinnaker control lines 18, 20. The spinnaker system incorporates a single control line rather than dual sheet and guy control lines to respective clews 14, 16 of the spinnaker 12.

An important aspect of the invention lies not only in the spinnaker pole structure itself indicated generally at 30, but additionally to additional primary spinnaker jibing system control lines 24, 26. Control line 24 labeled the starboard snatch guy, is formed of rope as are lines 18, 20, 24 and 26, with lines 24 and 26 terminating in snap shackles 28, which loosely snap onto the respective starboard and port lines 18, 20, so as to freely slide on those lines and which may be therefore at some distance from the shackles 32 which attach starboard and port lines 18 and 20 directly to the clews 16, 14 of spinnaker 12.

As in conventional spinnaker jibing systems, a downhaul or after guy 34 is attached to the outboard or forward end of the spinnaker pole by way of a conventional snatch block, which line 34 is led through a sheave 36 mounted on deck D of the yacht Y to the rear of the forestay 38 and which line 34 leads back to a cam cleat 40 adjacent to the mast M and on deck D. The spinnaker downhaul or after guy 34 is conventional common with the systems of the patents described above. The starboard and port control lines 18, 20 are led through blocks 22 to respective starboard and port winches W for controlling the trailing edge of the spinnaker 12 when lines 18 and 20 function as sheets.

Under the preferred mode of operation of the present invention, where one of the two primary control lines, either the starboard line 18 or the port line 20, remains under tension by the load on the spinnaker 12, the clew positions 16 and 14 are shifted by taking up lines 18, 20, respectively, or by letting out those lines. As may be appreciated, in the tightening of snatch guy lines 24, 26, at the outboard end of the spinnaker pole 30, the respective clews such as the leading edge clew 14 is moved into a position of near abutment with the outboard end of the spinnaker pole 30 as the pole is shifted from the starboard side of the forestay 38 across the back of the forestay in the direction of the spinnaker clew 14. At the same time, tension is exerted on the port primary control line 20 which functions to maintain the pole 30 at an angular position which may be generally in line with the axis of the yacht fore and aft or to a position at near right angles thereto. Such operation will be appreciated from the detailed description of the nature of the spinnaker pole, the lines carried thereby, the blocks employed as part of the spinnaker pole assembly and the detailed description of setting of the chute and the jibing of the same during off-wind movement of the yacht.

The inboard end of the spinnaker pole 30 is attached via a latched hook to a ring 42 mounted on a slide extending vertically on the front face of the mast. The ring is raised and lowered on the track to vary the vertical position of the inboard end of the spinnaker pole.

To raise and lower the outboard end of the spinnaker pole, the invention includes a conventional topping lift which extends from the mast at some height above the pole downwardly, normally be attached to the outboard or forward end of the pole. As may be appreciated, this invention utilizes a further baby lift as a fourth line carried internally within the hollow spinnaker pole 30 and which is connected at its outboard end to the lower end of the standard topping lift.

Figure 3:
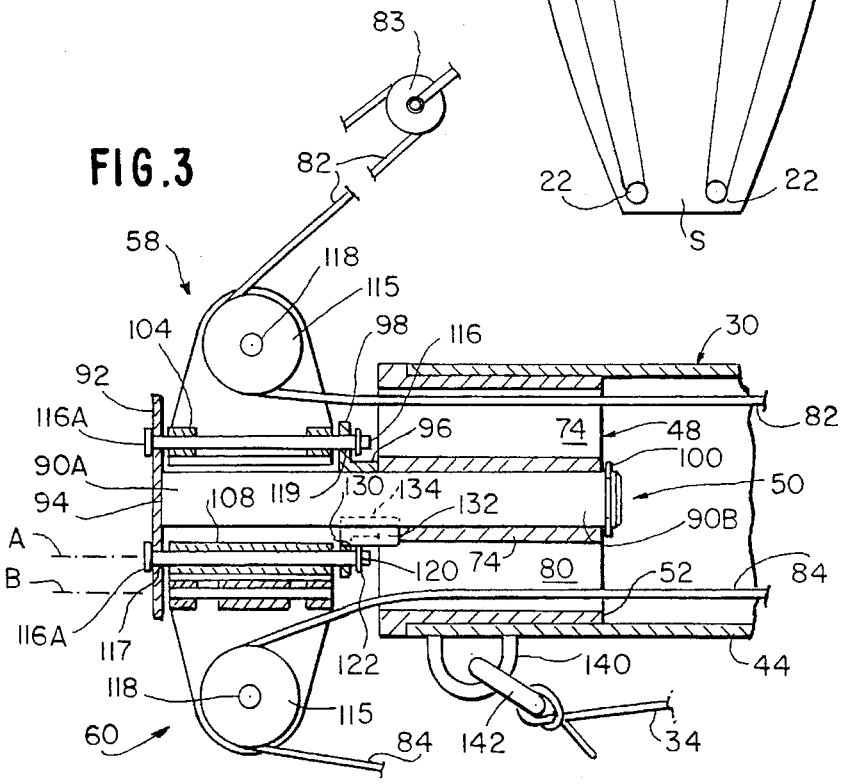
FIG. 3 is a vertical sectional view of the spinnaker pole outboard fitting and sheave assembly taken about line 3–3 of FIG. 2.
Figure 2:
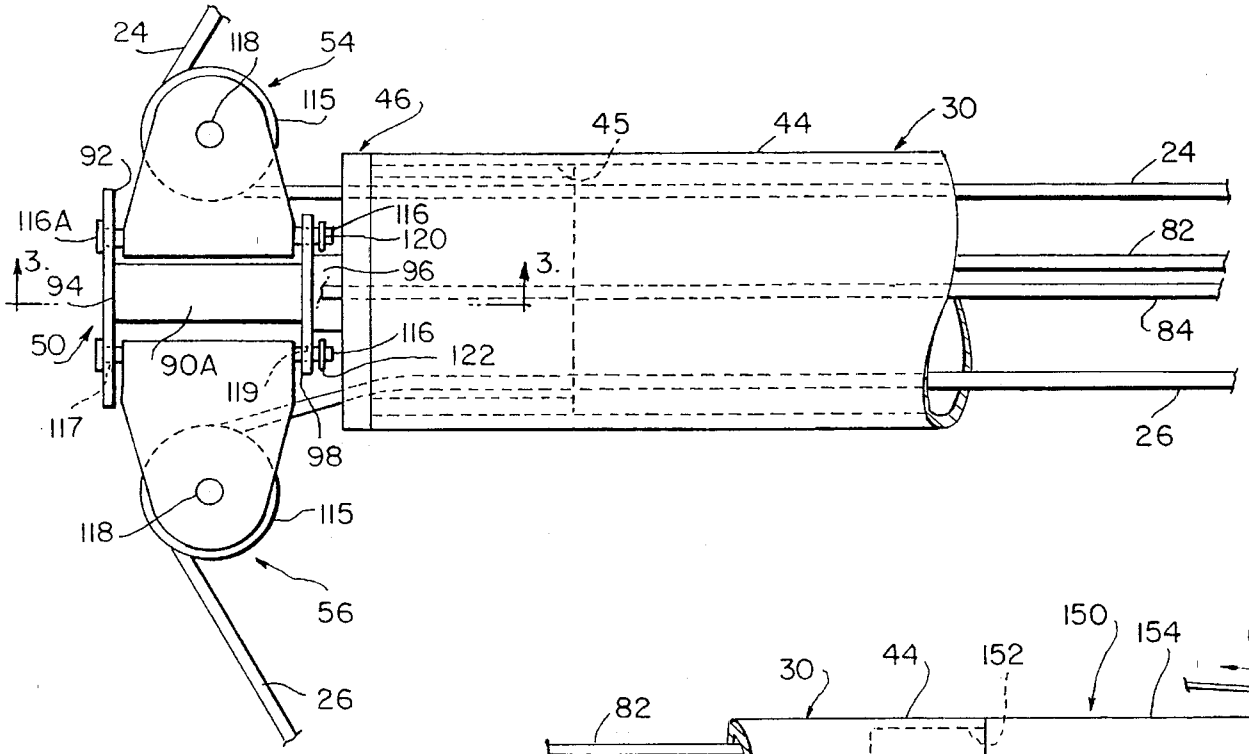
FIG. 2 is an enlarged top plan view, partially cut away, of the outboard end of an improved spinnaker pole forming a principal component of the dip pole jibing system of FIG. 1.

Referring next to FIGS. 2 and 3, these figures show in greater detail the makeup of the improved jibing spinnaker pole 30. The spinnaker pole is of hollow tubular form, preferably of aluminum or other light weight metal, although the spinnaker pole and the components thereof may be made of a carbon fiber reinforced extruded plastic material. The spinnaker pole 30 is formed of a number of sections. The middle tubular section 44 extends over the major length of the spinnaker pole. The outboard end of the pole 30 terminates in an outboard end fitting indicated generally at 46 and which is comprised principally of a popper assembly 48 which is riveted, welded or otherwise fixed to the main spinnaker tube 44 and carrying internally and coaxially a shaft assembly 50 which projects axially forward, beyond a poppet 52 and functions to support a plurality of sheaves circumferentially spaced about the outer periphery of the shaft assembly. The sheaves consist of a starboard hinged snatch guy sheave indicated generally at 54, a port hinged snatch guy sheave 56, both shown in FIG. 2, a top baby lift sheave 58, and a downwardly projecting double pivot, changing guy sheave 60, FIG. 3. The sheaves 54, 56, 58 and 60 are hinged to the forward end of the shaft assembly for pivoting about horizontal axes at the base portions of sheaves 54, 56 and 58, parallel to the axis of the spinnaker pole. The double pivot changing guy sheave 60 preferably pivots about spaced parallel axes, allowing the sheave 60 to pivot or swing through an overlapping arc of approximately 366° into face abutment with either starboard hinged snatch guy sheave 54 or the port hinged snatch guy sheave 56.

Figure 5:
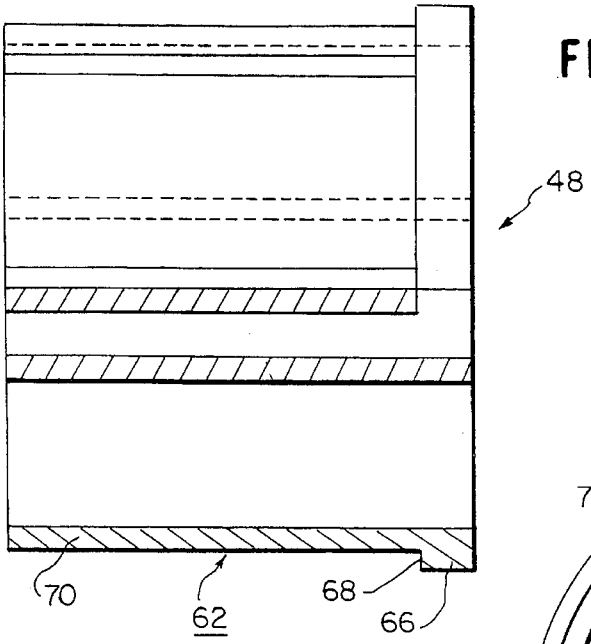
FIG. 5 is a partial vertical, sectional view of the popper body of the outboard end fitting of FIG. 3 of the spinnaker pole outboard end fitting of FIG. 3.
Figure 6:
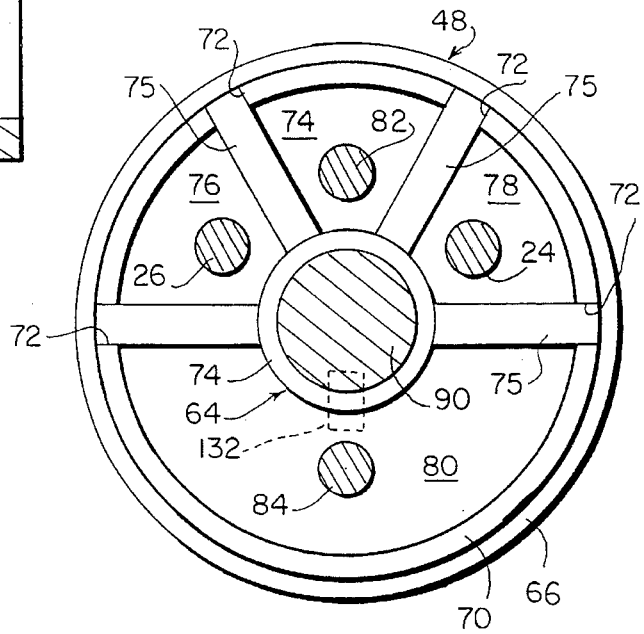
FIG. 6 is an end view of the spinnaker pole outboard end fitting of FIG. 5.

The poppet assembly 48 consists of two parts, a poppet body indicated generally at 62, FIG. 5, and a spider indicated generally at 64, FIG. 6. The poppet body 62 is formed of aluminum alloy as are all of the components of the poppet, being a short length cylinder and having a collar 66 at one end of an outside diameter equal to that of the outside diameter of the main spinnaker pole tubular section 44. The poppet body is recessed at 68 over the major portion of its length so that it may be slid into the outer end of the tubular spinnaker section 44, whose inner periphery is recessed as at 45 to receive the same. The collar 66 then abuts the end of the spinnaker main tubular section 44, FIG. 2. The poppet body may be fixed to the main spinnaker tubular section 44 by welding, by rivets or by other fastening means. The reduced diameter section 70 of the poppet body carries four elongated slots in the direction of the collar 66, but terminating short of the collar. The slots 72 are of uniform width and are circumferentially spaced 60° from each other.

The spider 64, FIG. 6, is created by a small diameter aluminum alloy tube 74 and four fins or ribs 75, which are welded to the exterior of the spider tube 74 and extend perpendicularly therefrom and likewise being spaced 60° from each other so that the outer ends fit into respective slots 72 within the poppet body. The components 66, 74, 75 and 72 may be welded to each other to effect a rigid poppet capable of supporting the shaft assembly 50. The spider 64 therefore defines with the poppet body 62, a top cavity 74, laterally opposed side cavities 76 and 78, and a bottom cavity 80, through which four individual control lines run and being segregated within respective cavities at the outboard end of the spinnaker pole. As seen in the end view of FIG. 6, cavity 74 houses a baby lift line 82, cavity 76 houses the port snatch guy 26, and cavity 78 houses the starboard snatch guy 24.

The principal component of the shaft assembly 50 resides in a stinger rod or shaft 90, having an inner end 90B sized to and fitted axially within the interior of the spider tube 74, such that the spider tube functions to rigidly mount the shaft assembly and maintain it coaxial with the main spinnaker tube section 44. A circular metal disk or cover 92 is welded coaxially to the outer end face 94 of the shaft 90, and a tubular stop 96 of aluminum or other metal is welded to shaft 90 intermediate of its ends and at a predetermined distance from the cover or disk 92. Tube 96 is radially enlarged to form an integral collar or small diameter disk 98 which functions along with the cover 92 to mount the four articulated sheaves 54, 56, 58 and 60. The stop 96 abuts one end of the spider tube 74 and the shaft 90 includes a first outer section 90A, about which the articulate sheaves are mounted between the cover 92 and the stop 96. Rearward section 90B projects through the spider tube 74. The length of the section 90B is such that a small portion of that section extends axially inwardly beyond the spider 64. A locking ring 100 maintains the shaft section 90B positioned within the spider tube 74, thereby coupling the shaft to the poppet body 62. The sheaves 54, 56, 58 and 60 are commercially available and may consist of Model Q30032 fairlead blocks on a hinged base plate under the trademark SCHAEFER®, preferably a ball bearing block to minimize the frictional restraint on the movement of the various control lines 24, 26, 82 and 84 passing through those blocks.

Figure 7:
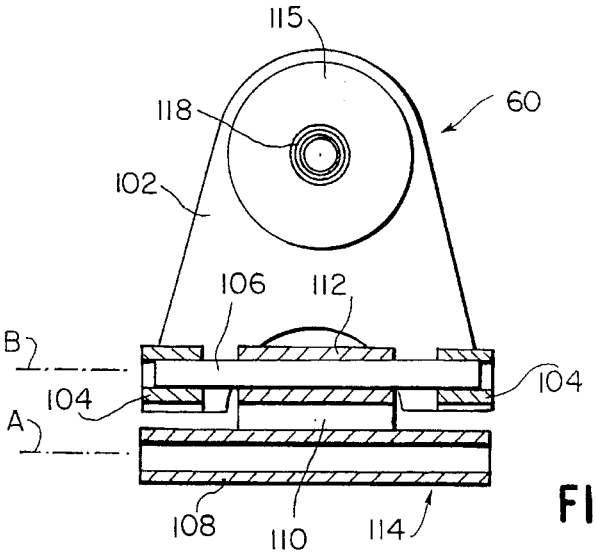
FIG. 7 is a vertical sectional view of the changing snatch guy bottom sheave of FIG. 5 showing the details of the double hinge mounting base thereof.

FIG. 7 illustrates a sectional view through the double pivot changing guy sheave 60 comprised of a folded over clam body or case 102, partially defining a tubular base 104 fitted with an elongated cylindrical pivot pin 106 sized to the internal diameter of the base tubular portions 104 and extending nearly the full length of the sheave. The clam shaped sheave body or case acts in conjunction with a sub-base tube 108 bearing a radially projecting flat metal fin or plate 110 at its center and having welded thereto a short axial length tube 112 forming with tubular base portions 104 of the sheave case a double axis pulley assembly indicated generally at 114. Tube 108 receives an elongated pivot pin 116, which in turn is supported by the shaft assembly 50, FIG. 3, such that the pulley assembly 114 provides pivoting of the base tube 108 about pivot axis A defined by pivot pin 116, while the sheave case 102 pivots about a further outboard pivot axis B defined by pin 106, thereby permitting, absent interference by the port and starboard hinged sheaves 44, 56 and the baby lift sheave 58, an overlapping swinging motion of changing guy sheave about the opposite sides of stinger rod or shaft 90. The pulley assembly short length tube 112 is positioned intermediate of the sheave case bearing tube sections 104 to which the pivot pin 106 is fixedly mounted, permitting swiveling of the sheave case 102 about axis B. Axes A and B are parallel to the longitudinal axis of the spinnaker pole 30.

Sandwiched between two flap sides of the clam type sheave case is a pulley wheel 115 which pivots about a ball bearing type axle assembly 118, ensuring low friction movement of a changing snatch guy line 84 line leaved about the peripheral groove of the pulley 115. The construction of the other sheaves 54, 56 and 58 is similar to that at 60, with the exception that there is no double pivot axis pulley assembly comprised of a second tube 108 and its web 110 for sheaves 54, 56 and 58 as per FIG. 7. The pivot pins 116 employed for all four sheaves each have a headed end 116A, while the opposite ends thereof each carries a peripheral groove at 120 which receives a snap retainer ring 122 after positioning of the same through the swivel hinge tubular portions 104 for respective sheaves 54, 56 and 60 as per FIGS. 2 and 3. Aligned holes are provided, respectively, within the cover 92 at 117 and at 119 within stop flange 98 of stop 96 at four circumferentially spaced locations. Tubular stop 96 has a narrow tubular slot 130 which receives a short length key 132 having a projecting portion which fits into an elongated keyway slot 134 within shaft portion 90B to lock stinger rod 90 to stop 96.

As per FIG. 3, a U-shaped ring 140 may be fixed to the exterior of the main spinnaker tubular section 44 to which the end of the downhaul line or after guy 36 is coupled via an appropriate snap shackle 142. The ring 140 may be directly welded to the outer periphery of the spinnaker tube section 44 or may terminate in an arcuate plate which is riveted or otherwise fixed to the exterior of the spinnaker tube section 44 at its outboard end in accordance with FIG. 3. Such arrangements are conventional as seen from the patents discussed in detailed above.

Figure 4:
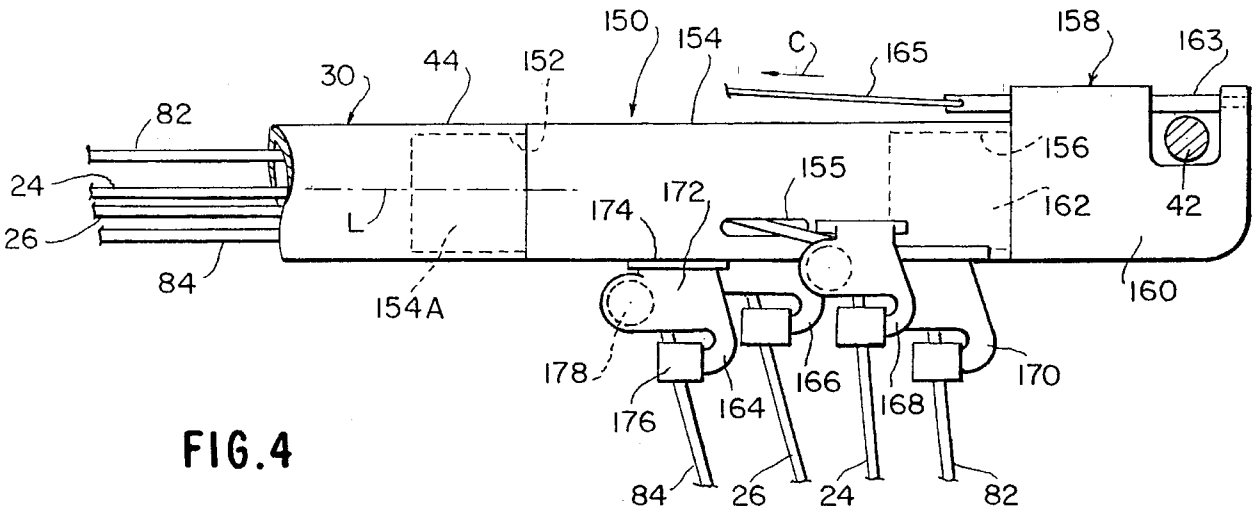
FIG. 4 is a top plan view of the inboard end of the spinnaker pole of FIG. 1.

The spinnaker pole 30 may have a main tubular section 44 of 10 feet or several tens of feet in length and terminates, FIG. 4, in a cleat tube assembly 150 followed by a spinnaker pole inboard end fitting 158. The cleat tube assembly 150 is formed of a short length hollow tubular section 154 including a reduced diameter portion or male projection 154A which fits within a recessed portion 152 of tube 44 at its innermost end. The cleat tube assembly 154 therefore abuts the inner end of the main spinnaker tubular section 44. The two parts may be welded or riveted together or alternative means may be employed for fixedly coupling the two members together. The rear end of the cleat tube assembly short length tube 154 is recessed at 156 so as to receive a reduced diameter male projection 162 of the inboard end fitting 158, the body of which constitutes a hook for engagement with the ring 42 mounted to the mast for vertical movement on an appropriate track (not shown) as described previously so that the inboard end of the spinnaker 30 may be raised an lowered and preset in position at a given height above the deck D of the yacht Y. A spring biased plunger 163 is mounted to the block 160 and retracts so as to permit release of the inboard end fitting from the ring 42. As desired, the plunger is moved rearwardly against the spring by pulling on lanyard 165 in the direction of arrow C.

The projection 162 of the inboard end fitting is appropriately welded to or riveted to the inner end of the cleat tube assembly. Appropriately, the cleat tube assembly pivotably mounts bases 174 of individual head knocker blocks or pivoting exit blocks 164, 166, 168 and 170 as an array at circumferentially and longitudinally spaced positions on one side of the cleat tube assembly. These blocks are all identical or nearly so and may be of head knocker pivoting exit block with cam cleat under part No. 141 sold commercially under the registered trademark HARKEN®, or readily commercially available equivalents. Indeed, such exit block and cam cleat is an outgrowth of a similar arrangement employed in FIG. 1 of the Ridder U.S. Pat. No. 3,228,372 discussed above.

For all four blocks 164, 166, 168 and 170, a pivoted base 174 supports a block body 172 for articulation about an axis parallel to the longitudinal axis of the pole 30, a line passes about the periphery of a pulley 178 carried internally of body 172 and exiting from that body while also passing through a cam cleat as at 176, the numerals being applied to block 174, FIG. 4. The free ends of the four control lines run to appropriate color coded bags which may be closed via VELCRO® hook and loop closure material flaps.

As may be appreciated from the above description and as described in the following description of the jibing system set-up and operation of the same, there are four control lines which run through the length of the spinnaker tube. The line 82 exiting the outboard end fitting at the top cavity 74 is the baby lift and preferably forms a double purchase via block 83, doubling back with its end fixed to the top of cover 92 of shaft assembly 50. Block 82 attaches directly to the topping lift, such as that at 19, FIG. 1 of the McAlpine U.S. Pat. No. 5,347,945.

The conventional dip pole method of jibing, of which this invention is a variation, is described within the November 1989 issue of Sailing World Magazine at page 36 in an article by Scott Vogel. An understanding of jibing procedures for spinnakers in general may be found within the various patents discussed in limited terms within this publication and those publications are incorporated expressly by reference herein. The baby lift and topping lift combination within the jibing system as illustrated in the drawings herein and discussed in detail within the specification allows the foredeck crew to regulate the outboard pole-end height without assistance from the cockpit and utilizes once the topping lift is set at the mast the adjustment of the outboard pole end height by release or tensioning the baby lift line 82 through head knocker block 170, closest to the mast.

In order from the mast in the direction of the outboard end of the spinnaker pole 30, baby lift line 82 exits through head knocker block 170, starboard snatch guy control line 24 exits through head knocker block 168, port snatch guy control line 26 exits through head knocker block 166 and the changing snatch guy control line 84 exits through head knocker block 164. All lines exit from the interior of the pole via elongated fairlead slots such as that 155 associated with head knocker block 168. Each fairlead slot for the four lines 24, 26, 82 and 84 is immediately in front of and aligned with the pivot mounting base 174 of that head knocker block. Such fairlead slot is equivalent to that of the Ridder et al. U.S. Pat. No. 3,228,372 in FIG. 1 at 52.

The port and starboard snatch guys are primary snatch guys and may be appropriately colored green to starboard and red to port. For contrast, the changing snatch guy may be of yellow rope. Thus, the inboard end of the spinnaker pole 30 is principally characterized by the four head knocker blocks 164, 166, 168 and 170, which are hung from the cleat or spacer tube assembly 150 through associated in-line fairlead slots.

It should also be appreciated that by using a rectangular link, the hinged changing snatch guy sheave 60 is double hinged to permit articulation through an overlapping arc of approximately 366°. The pulleys of the respective sleeves are aligned with the lines passing thereabout and leaving the outboard end of the spinnaker pole 30, minimizing friction and preventing wear under the heavy loads on the primary snatch guys and the changing snatch guy during flying of the spinnaker, and particularly during the jibing sequence, in changing from port to starboard tacks and vice versa. In setting up the spinnaker jibing system 10, FIG. 1, the inboard end fitting 158 of the spinnaker pole 30 is attached to the mast like the poles within the references above. Differently, however, the baby lift is pulled from the upper cavity 74 and attached via block 83 or directly to the lower end of the normal topping lift. Initially, the "upper" topping lift is preset by the cockpit crew to set the outboard end of the spinnaker pole 30 to slightly more than the maximum height anticipated for the outboard end of the spinnaker pole during conventional spinnaker use.

The changing snatch guy 84 may be eased at the inboard end by releasing the same from the cam cleat 176 of head knocker block 164 and the snap shackle at the outboard end of the changing snatch guy is brought back to the portion of the same line 84 exiting the exit slot or fairlead 158 for knocker block 164 and its cam cleat 176, and attached thereto. It should normally be left in this position since the changing snatch guy 84 is seldom used, normally limited to changing of spinnakers by first hoisting a second spinnaker outside or inside of the active spinnaker.

During racing on the weather legs, the spinnaker pole 30 should be rigged to the mast and the topping lift, but the snatch guys 24 and 26 should be unrigged and those lines stored in their respective bags attached tightly to the pole. This prevents solid water on deck from grabbing the tails and washing the lines and bags overboard, where bags act to store the inboard ends of the respective lines. Prior to hoisting the spinnaker, the primary snatch guys 24, 26 are eased at the inboard end of the pole, and the outboard ends thereof via snap shackles are attached to respective port and starboard spinnaker control lines 18, 20. The leeward side snatch guy should be attached to the spinnaker sheet at that leeward side, whether port or starboard, after the first spinnaker set. With the Genua or head sail up, the windward snatch guy must be taken over the lazy genoa sheet and attach to the appropriate spinnaker sheet, with the baby lift eased and restrained by VELCRO or the like to the base of the mast, the foredeck will be clear for tacking. Preferably, each side deck is marked with a color-coded tape abeam the winches, which are employed in controlling the spinnaker sheets (or guys) 18, 20. Likewise, by marking the spinnaker sheets when the marks are aligned, the snap shackles are about 6 inches forward of the forestay. The marks must match during jibing operation to facilitate a quick and effective jibe. Assuming a jibe commences from the position shown in FIG. 1, where the yacht is on a port tack with the main not shown to the starboard side of the yacht and the spinnaker pole to the port side, with the wind coming over the port side from left to right, after the spinnaker has been raised and the spinnaker operated by tension applied to the starboard control line 18 acting as the sheet and attached to starboard side trailing edge clew 16, and with the leading edge spinnaker clew 14 proximate to the outboard end of the spinnaker pole 30. As the yacht turns toward the starboard side and heads downwind, as under conventional practice, the spinnaker pole 30 is pulled rearwardly by additional tension on the port control line 20 functioning as the guy in the two-line system to square the pole back, that is to bring it at right angles to the longitudinal axis of the yacht Y. With the jibing system of the present invention, one proceeds dead down wind for less than a minute, eliminating the need to aim the yacht dead down for the period of time while the crew gets things hooked up on the foredeck, because the yacht is always ready to jibe almost instantly since there is no bowman anywhere near the bow. A mast man is still required as an essential part of the crew, but instead of a bowman, the bowman becomes a pole man, and there is no need for the pole man to go further forward for spinnaker work than the distance he can reach from the mast.

Assuming that the yacht desires to change from a port tack reach to a reach on the starboard tack, the pole man eases the baby lift line 82 without changing the topping lift, thereby dropping the outboard end of the spinnaker pole 30, while a crewman takes up the slack in the downhaul 34. The downhaul is pulled tighter, stretching the spinnaker luff and the mast man raises the inboard end of the pole. The pole shifts from its normal horizontal position to a forwardly and downwardly inclined position. The helmsman initiates the turn of the yacht from left to right, and as the yacht Y goes dead down with the spinnaker 12 centered with forestay 38, the guy trimmer hardens the starboard control line 18 which is to be the new guy, and the pole man releases the windward snatch guy and baby lift, lines 26 and 82 at head knocker blocks 166 and 170, respectively. The new sheet trimmer at the port side winch W and the guy trimmer at the starboard side, winch W now align the sheets 18, 20 to their deck marks as the helmsman brings the sterns through the wind. The pole man then hardens the new snatch guy 24 as the yacht comes over to starboard tack. The downhaul 34 is eased, the mast man lowers the inboard end of the spinnaker pole 30 on the mast M via the ring on the track at the forward face of the mast, and as soon as the pole man completes snatching the new guy by tensioning the same, he informs the crew that the jibe is completed and readjusts the baby lift by releasing the baby lift so that the spinnaker pole comes up to its normal horizontal position at some distance above the deck D. In the sequence, back in the cockpit C the former sheet trimmer on the starboard side becomes a guy trimmer, and the sheet 18 becomes a guy, while the former guy trimmer on the port side becomes a sheet trimmer and control line 20 becomes a sheet rather than a guy.

With the system of the present invention, no crew member needs to go forward to place the guy in the pole end, and there is no chance that the sailor on the bow would be battered, bruised or knocked off the yacht Y by the swinging spinnaker pole during the jibing sequence, and the only period of sailing dead down wind is for the short time necessary to gently turn the yacht from one tack to the other.

The jibing system of the present invention has particular application to quickly and effectively changing chutes (spinnakers). Whether the yacht is racing dead down or on a reach, the system is designed to make a spinnaker change easy. The new spinnaker bag is set either at mid foredeck or on a leeward rail. A pair of sheets (not the sheets 18, 20 hooked to the existing spinnaker) are hooked up as if one were launching any spinnaker. In the spinnaker jibing system of this invention, there is no need to worry about connecting of a new guy to the outboard pole end. The changing snatch guy shackle is pulled to windward side of the yacht and attached to the new spinnaker guy. The pole man then hardens the changing snatch guy and the new guy will move proximate to the outboard end of the pole. The mast man then raises hoists the spinnaker by way of a second spinnaker halyard, and the sheet and guy trimmers act on the respective second set starboard and port sheets and controls the second spinnaker either inside or outside of the previously set spinnaker.

At this point, the leeward snatch guy will be removed from the sheet attached to the old spinnaker and reattached to the sheet of the new spinnaker, except in very light air. In light air, one may remove the leeward snatch guy and clip it to a lifeline, remembering to reattach it before any jibe from one tack to the other.

The old spinnaker may be taken down by any preferred manner. If one normally allows the guy to run free, the pole man must release the snatch guy simultaneously so that the outboard end will be pulled into the yacht by the guy. This is especially important on a run so that one will not have to get the end inboard and send somebody to the bow to give you access to this vital control. The old snatch guy for the first active spinnaker may be kept at the inboard end of the pole in the manner described in the initial setup of the system so that it is available for any additional sail change such as the necessity to go to a smaller, third spinnaker if wind conditions increase substantially, prior to completing the downwind spinnaker run.

It should be appreciated by those of ordinary skill in the art that numerous variations and/or modifications may be made to the spinnaker pole and to the spinnaker jibing system set forth within the illustrated embodiment of the invention without departing from the spirit or scope of the invention as broadly described. The embodiment illustrated and described is not considered restrictive in any respect.

I claim:

1. A dip jibe spinnaker pole for a sailing yacht having opposite port and starboard sides and a main mast, a spinnaker sail supported on said mast and including port and starboard clews at opposite corners along a foot thereof, a topping lift extending upwardly along said main mast and respective control spinnaker lines acting alternatively as a guy and a sheet connected at one end to each of said clews and led along respective port and starboard sides to a cockpit, aft said mast, said spinnaker pole comprising:

an elongated spinnaker pole tubular body having a longitudinal axis and inboard and outboard ends, an inboard end fitting coupled to said tubular body at said inboard end for detachably pivotably mounting said spinnaker pole to said mast, an outboard fitting fixed to the outboard end of said tubular body, the improvement comprising:

at least two sheaves including port and starboard snatch guy sheaves, means for mounting said snatch guy sheaves to opposite sides of said spinnaker pole outboard fitting for pivoting about axes parallel to said longitudinal axis of said pole, with said sheaves extending outwardly from said fitting such that the sheaves articulate through an arc of approximately 180°, at least two snatch guys including port and starboard snatch guys led through said pole, said outboard end fitting and said port and starboard snatch guy sheaves, respectively, from said inboard end and terminating in snap shackles loosely coupled to respective ones of said port and starboard control spinnaker lines proximate to said spinnaker sail clews, whereby said sheaves pivot to accommodate rise and fall and fore and aft movement of said snatch guys during dip jibing of the spinnaker pole from a starboard tack upon hauling in of one snatch guy and letting out of the other snatch guy, thereby minimizing friction between the snatch guys and the snatch guy sheaves and reducing wear on said snatch guys.

2. The dip jibe spinnaker pole as claimed in claim 1, wherein said at least two snatch guys further include a changing snatch guy and said spinnaker pole further comprises a changing snatch guy sheave having a base fixed to said outboard end fitting at a bottom thereof via a double pivot mount for pivoting said changing snatch guy sheave about two spaced parallel axes which are parallel to the longitudinal axis of said pole such that said changing snatch guy sheave articulates through an overlapping arc of approximately 366°, said changing snatch guy being led through said changing snatch guy sheave, said outboard end fitting and said spinnaker pole tubular body from said inboard end, thereby facilitating changing of spinnakers.

3. The dip pole jibe spinnaker as claimed in claim 2, wherein said spinnaker pole further comprises a baby lift sheave having a base articulately mounted to the top of the outboard end fitting, inbetween said port and starboard snatch guy sheaves, for pivoting about an axis parallel to the longitudinal axis of said pole and extending outwardly from said outboard end fitting, and a baby lift line led through said spinnaker pole tubular body from said spinnaker pole inboard end, said outboard end fitting and through said baby lift sheave, and means for connecting the outboard end of said baby lift line to said topping lift, whereby the outboard end of the spinnaker pole may be initially raised to a given height via said topping lift for initially setting said spinnaker sail, and wherein subsequently thereto the outboard end of the spinnaker pole may be raised and lowered by hauling in and letting out of the baby lift line through said tubular spinnaker pole.

4. The dip jibe spinnaker pole as claimed in claim 3, wherein a plurality of head knocker blocks are articulately mounted to the periphery of the spinnaker pole adjacent said inboard end along one side thereof aft of respective fairlead slots within a side of said pole, and aligned therewith, through which tail ends of said snatch guys and said baby lift lines are led, thereby permitting a single crew member to control completely the jibing control lines led to the spinnaker pole for dropping the outboard end of the spinnaker pole and raising the same, the swinging of the spinnaker pole from the starboard to the port side of the yacht and vice versa during jibing, and for facilitating the changing of spinnakers, at a single position adjacent the mast and to one side thereof.

5. The dip jibe spinnaker pole as claimed in claim 1, wherein said outboard end fitting comprises a stinger rod projecting axially from the outboard end of said spinnaker pole tubular body and being of a diameter smaller than the diameter of said tubular body, and wherein said at least two snatch guy sheaves are mounted for articulation about the periphery of said stinger rod.

6. The dip jibe spinnaker pole as claimed in claim 5, wherein a tubular metal poppet body having an outside diameter on the order of the inside diameter of the spinnaker pole tubular body is fixedly mounted internally of said spinnaker pole tubular body at said outboard end and is concentric therewith, and wherein said poppet body includes means for fixedly mounting said stinger rod coaxially therewith and projecting axially outwardly therefrom.

7. The dip jibe spinnaker pole as claimed in claim 6, wherein said means within said poppet body for fixedly mounting said stinger rod comprises a plurality of circumferentially spaced, elongated slots within said tubular poppet body extending parallel to the axis of said body, a spider comprising a small diameter cylindrical tube, a plurality of ribs fixed to the outer periphery of said small diameter cylindrical tube and projecting radially therefrom at spaced locations corresponding to said slots, the outboard ends of said ribs being positioned within said slots and being fixed thereto, whereby said ribs define with said poppet body and said small diameter cylindrical tube a plurality of segregated cavities through which said snatch guys are led, with said cavities opening in proximity to respective sheaves for facilitating alignment and passage of the snatch guys about the periphery of pulleys carried by said snatch guy sheaves, and wherein said small diameter tube has an inside diameter slightly larger than the diameter of said stinger rod, said spider is concentrically positioned within said poppet body and supports an inboard end of said stinger rod, and means for locking said stinger rod to said small diameter tube.

8. The dip jibe spinnaker pole as claimed in claim 7, wherein said means for locking said stinger rod to said small diameter tube of said spider comprises an elongated slot within said small diameter tube, a corresponding elongated keyway within the periphery of said stinger rod portion carried by said small diameter tube aligned with and facing said elongated slot of said small diameter tube, and a key fitted to said elongated slot within said tube and said aligned keyway, thereby preventing rotation of said shaft within said tube.

9. The dip jibe spinnaker pole as claimed in claim 6, wherein a pair of longitudinally spaced disks are fixedly mounted to said stinger rod forward of said poppet body at longitudinally spaced positions and extend radially outwardly from the periphery of the stinger rod, and wherein aligned holes are formed within said disks at circumferentially spaced, longitudinally aligned positions corresponding to the positions of said sheaves, and wherein pivot pins project through said aligned holes at said circumferentially spaced positions, and said sheaves each include a case having a base thereof about respective ones of said pivot pins and constituting said means for articulation of said sheaves.

10. The dip jibe spinnaker pole as claimed in claim 5, wherein said changing snatch guy sheave comprises a sheave case, a hinge pin extending longitudinally through the base of said sheave case, and a web is interposed between a hinged member carried by a further pivot pin of said changing guy sheave and one of said pivot pins projecting through aligned holes of first and second longitudinally spaced disks fixedly mounted to said stinger rod, thereby providing a double pivot connection for said changing snatch guy sheave.

11. A spinnaker jibing system on a sailing yacht having a hull having port and starboard sides and mounting an upright mast, a forestay a spinnaker sail secured at a head corner to said mast, a dip jibe spinnaker pole having opposite outboard and inboard ends, an adjustable elevation control means for variably adjusting elevation of the inboard end of said spinnaker pole, a topping lift carried on said mast above said spinnaker pole and including a topping lift line having a free end extending downwardly from said mast in the direction of the outboard end of said spinnaker pole, said spinnaker pole comprising a hollow tube body, said spinnaker including port and starboard clews at opposite corners along the foot thereof, first and second control spinnaker lines acting alternatively as guys and sheets connected at one end respectively to each of said clews and leading to a cockpit rearwardly aft of said mast, an outboard end fitting on said tubular spinnaker pole body, the improvement comprising:

a plurality of snatch guy sheaves including at least laterally opposite port and starboard snatch guy sheaves mounted respectively to opposite sides of said pole and each having a base thereof articulately mounted to a periphery of said outboard end fitting for pivoting about axes parallel to a longitudinal axis of said spinnaker pole, said sheaves projecting outwardly from said outboard end fitting such that said sheaves articulate through an arc of approximately 180°, at least two snatch guys including port and starboard snatch guys led through said pole from said inboard end and through said outboard end fitting and through respective port and starboard snatch guy sheaves and terminating in snatch shackles loosely coupled to respective ones of said first and second control spinnaker lines proximate to said spinnaker sail clews to allow said sheaves to pivot to accommodate rise and fall and fore and aft movement of the snatch guys during dip jibing of the spinnaker pole behind said forestay, thereby minimizing friction between said snatch guys and said sheaves and reducing wear on said snatch guys, while eliminating the need for a bow man at the outboard end of said spinnaker pole.

12. The spinnaker jibing system as claimed in claim 11, further comprising a baby lift sheave having a base articulately mounted to the periphery of said outboard end fitting intermediate of said port and starboard snatch guy sheaves and at the top of said spinnaker pole for pivoting about an axis parallel to the longitudinal axis of said pole, and a baby lift line led through said pole from said inboard end and through said outboard end fitting and said baby lift sheave and being operatively connected to the end of said topping lift, whereby in initially setting the spinnaker sail and positioning the outboard end of said spinnaker pole at a given height above the deck of the yacht, the height of the outboard end of said pole may be set via said topping lift, while during jibing, the outboard end of the spinnaker pole may be raised and lowered by hauling in or letting out of the baby lift line, respectively, at the inboard end of the spinnaker pole adjacent the mast.

13. The spinnaker jibing system as claimed in claim 11, further comprising a changing snatch guy sheave having a base, and means for articulated mounting of said base of said sheave to the side of said outboard end fitting for pivoting about dual axes parallel to the longitudinal axis of said pole, with said changing snatch guy sheave projecting outwardly from said outboard end fitting at the bottom thereof such that said changing snatch guy sheave may pivot on said base through an overlapping arc of approximately 366° to opposite sides of said spinnaker pole selectively adjacent and parallel with said port or starboard snatch guy sheaves, and wherein said yacht further comprises a changing snatch guy led through said pole from said inboard end through said outboard end fitting and said changing snatch guy sheave for facilitating changing of spinnakers face-to-face inside or outside of said spinnaker sail.

* * * * *